United States Patent [19]

Weller

[11] 4,447,159

[45] May 8, 1984

[54] UNIVERSAL WORLD TIME AND DATE CLOCK

[76] Inventor: Barton L. Weller, Box 68, Monroe, Conn. 06468

[21] Appl. No.: 388,245

[22] Filed: Jun. 14, 1982

[51] Int. Cl.[3] ..... G04B 19/22

[52] U.S. Cl. ..... 368/23; 368/21

[58] Field of Search ..... 368/21–24

[56] References Cited

U.S. PATENT DOCUMENTS

| | | | |
|---|---|---|---|
| 536,504 | 3/1895 | Arriga | 368/21 |
| 694,256 | 2/1902 | Day | 368/23 |
| 2,603,940 | 7/1952 | Packard | 368/24 |
| 2,721,442 | 6/1952 | Pettigrew, Sr. | 368/23 |
| 3,091,915 | 6/1963 | Pawl | 368/24 |

FOREIGN PATENT DOCUMENTS

| | | | |
|---|---|---|---|
| 676613 | 11/1964 | Italy | 368/21 |
| 133682 | 1/1946 | Sweden | 368/23 |

*Primary Examiner*—Bernard Roskoski

*Attorney, Agent, or Firm*—Thomas L. Tully

[57] ABSTRACT

A novel twenty-four hour clock (10) providing a continuous display representative of the rotation of the Earth relative to the heavens, and the changing position of illustrated geographic continents (33*a*, etc.) of the Earth relative to the fixed position of the Sun, thereby providing the viewer with a visual display of the local time of day and also the time of day in each of said geographic continents. The present clock (10) includes a continuous display of fixed indicia (35*a* and 36*a*) representative of a location in the heavens, 180° around the Earth from the fixed location of the Sun, coinciding with the occurrence of midnight at each geographic area of the Earth as said geographic area passes thereby, the geographic area in which the Fiji Islands and New Zealand are located being designated the International Date Line (30). The present clock (10) also includes moving indicia (35 and 36) of the changing geographic portions of the Earth existing under the new day and the old day as concurrently experienced in different geographic areas of the Earth, thereby providing the viewer with a visual indication or, if desired, digital identification (52, 53) of the local calendar day and the calendar day in each of said continents.

10 Claims, 3 Drawing Figures

UNIVERSAL WORLD TIME AND DATE CLOCK

BACKGROUND OF THE INVENTION

Twenty-four hour clocks are in current use, particularly in the aviation and military fields. Such clocks have a circular dial or face which is divided into arc points spaced by 15° from each other around the dial to provide a total of twenty-four points, each representing an hour of the day. Generally, the top location, corresponding to the hour "12" on a twelve-hour clock, is designated as "0" or "24" on a twenty-four hour clock dial, with the numbers "1" through "23" progressing clock-wise.

Such clocks have an hour hand, a minute hand and a second hand, which make one complete revolution each twenty-four hours, each 60 minutes and each 60 seconds, respectively. The hour hand may comprise a World time radiant or disk which may include a local hour hand which is adjustable relative thereto to indicate the local hour time and the concurrent hour time in a plurality of geographic areas. The minutes and seconds indicated by the other hands are universal.

Realizing the relationship between the rotation of the hour hand of a twenty-four hour clock and the rotation of the Earth relative to the Sun, it has been proposed to provide a twenty-four hour clock having a geographic disk or radiant, corresponding to the Southern Hemisphere, which rotates with the hour hand and thus provides a visual indication of the changing location of the illustrated continents of the Earth relative to the axis of rotation of the Earth and to the fixed position of the Sun, and a visual indication of the local time in each of said geographical areas. If a Northern Hemisphere radiant was used, the clock would be required to rotate in the unconventional counterclockwise direction. Hence, the Southern Hemisphere is illustrated, to coincide with the true clockwise rotation of the Earth relative to the Sun.

Reference is made to U.S. Pat. No. 694,256 which discloses a twenty-four hour clock which provides the viewer with a visual indication of the local time of day, shown by the position of the hour hand, and with a simultaneous visual indication of the concurrent time of day in each of the geographic areas shown on the geographic radiant or disk, indicated by the position of said geographic areas, relative to the location of the Sun which is pictured in fixed position on the dial face at the 1200 hour position (noon or prime meridian). The other twenty three hour positions, or alternate even-hour positions, are also indicated around the outer periphery of the dial face, each hour position being spaced from the next by 15° increments. This conforms the clock face to a hemisphere of the Earth which, by international agreement, has been divided into twenty-four time zones of 15° longitude each. Greenwich, England has been designated time zone zero and is the Prime Meridian. Therefore, the Earth latitude which is positioned 180° latitude from Greenwich, i.e., the Fiji Islands and New Zealand, is designated as the International Date Line. At noon, the Prime Meridian Greenwich is directly under the Sun. This is the only instant of each twenty-four hour period in which the entire Earth is experiencing the same day or calendar date. However, the next second brings a new day or calendar date in the International Date Line time zone so that different portions of the Earth are simultaneously experiencing two different days or calendar dates.

Conventional twenty-four hour clocks are useful in the aviation and military fields for providing a universal reference for time, i.e., Greenwich Mean Time. Also, such clocks are very desirable for people who travel around the World frequently and/or who are in frequent contact with people in various other parts of the World, such as business people with business associates or companies located around the World. Thus, it is useful or necessary to be aware of the time of day in other parts of the World before attempting to make an international telephone call or before making airplane reservations or other commitments which can be more effectively carried out if planned to coincide with certain local hours of the day in other parts of the World.

However, conventional twenty-four hour clocks have at least one important disadvantage with respect to the visual display of World-wide time. As mentioned supra, a twenty-four hour clock encompasses two different calendar days at all times except at the instant when noon occurs at the Prime Meridian, i.e., in the Greenwich time zone and the International Date Line, time zone 12, 180° latitude from Greenwich is at 24 hours or midnight. Thus, while a twenty-four hour clock provides a quick visual indication of the time of day in other continents of the World, it does not include any means for providing a quick visual indication of those portions of the World experiencing the same day as the local day and those portions of the World experiencing a different day. Such information is important in connection with the making of business telephone calls on a Friday or a Monday to parts of the World where it may not be a business day, i.e., Saturday or Sunday. Such information is also important in connection with meeting date deadlines, expiration dates and other commitments where the first or last days of a month or year may be critical.

SUMMARY OF THE INVENTION

The present invention relates to a novel twenty-four hour date clock which not only provides a quick visual indication of the local time of day and the time of day in other international time zones or geographic areas but which also provides a quick visual indication of the day of the week in the local area, the portion of the Earth which is experiencing the same day of the week and the portion of the Earth which is experiencing a different day of the week, relative to the local day.

According to an embodiment of the invention, the present World time watch provides a changing digital or numerical display of the calendar dates of the two concurrent days encompassed by the twenty-four hour clock, with said display being correlated to symbols on the hour hand or radiant to show the different days co-existing in different areas of the World. The display can comprise the calendar dates, alone, or in combination with identification of the day and/or month and/or year.

DETAILED DESCRIPTION

Figure 1:
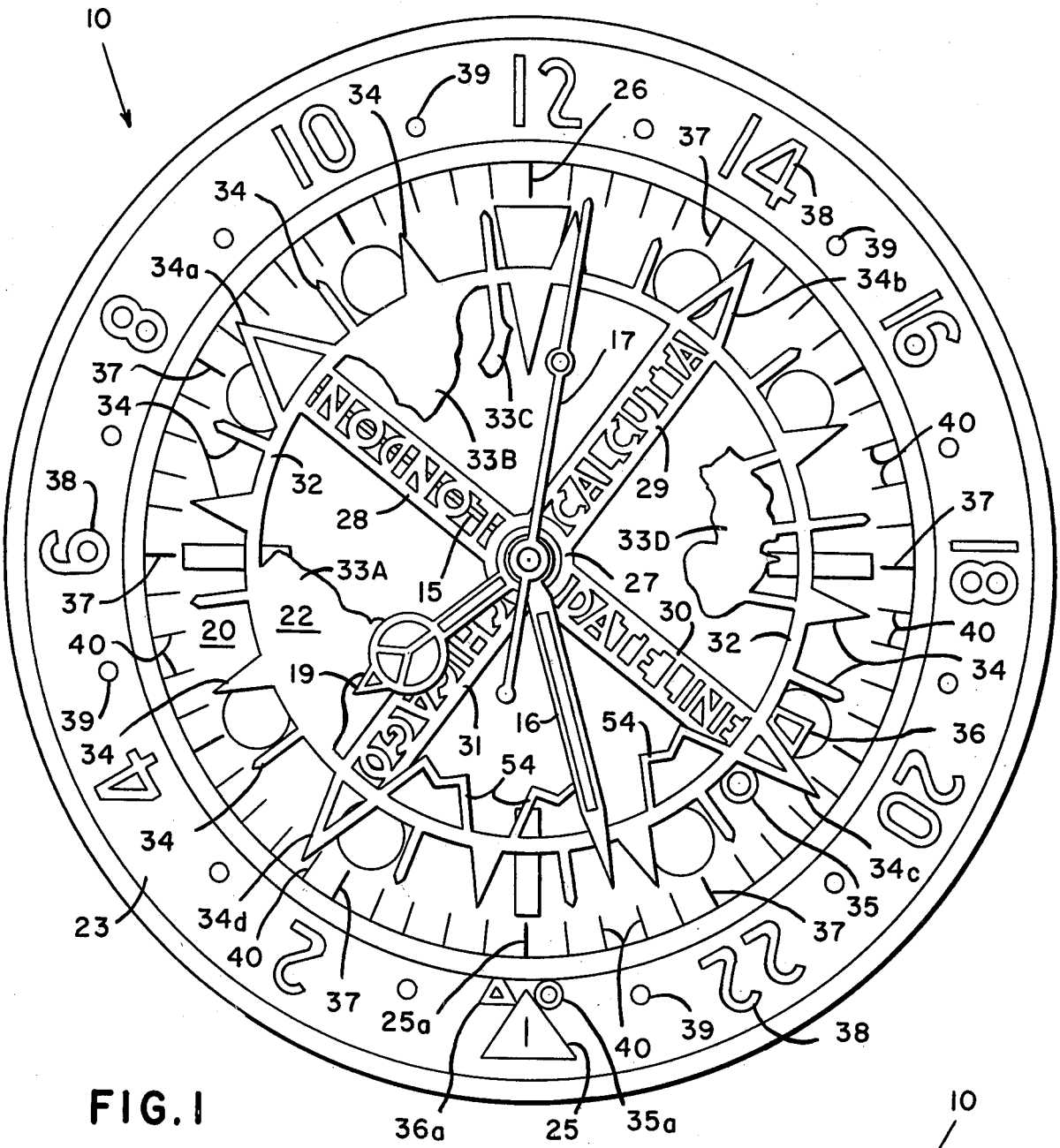
FIG. 1 is a front view of a twenty-four hour clock according to one embodiment of the present invention.
Figure 2:
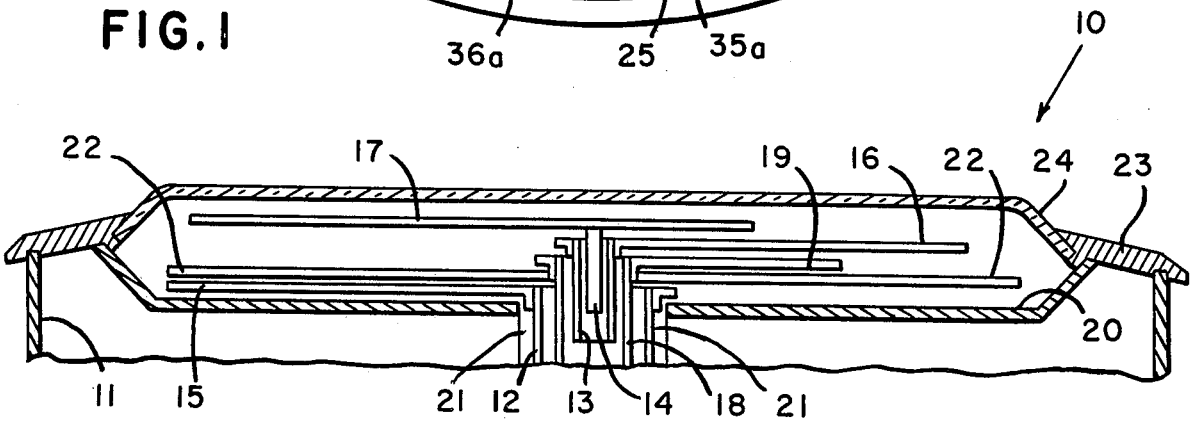
FIG. 2 is a cross-section of the clock of FIG. 1 taken along the line 2—2 thereof.

FIGS. 1 and 2 illustrate the front view and cross-sectional view, respectively, of the face of a novel twenty-four hour clock according to the present invention, the term "clock" being used generically to include timepieces of all types and sizes such as mechanical and electrical wall clocks, desk clocks, wrist watches, pocket watches, or the like. Since the internal chronometer mechanism for twenty-four hour clocks having three hands or radiants which make one complete revolution each twenty-four hours (hour hand), each hour (minute hand) and each minute (second hand), respectively, are well-known, such mehcanism is not illustrated by the present drawings which only illustrate the novel features of the faces of the present clocks.

The embodiment of FIGS. 1 and 2 of the drawing comprises a clock 10 having a casing 11 which contains the chronometer mechanism or works (not shown) which controls the relative movement of the coaxial drive sleeves 12, 13 and 14 to which the external hour, minute and second hands 15, 16 and 17, respectively, are attached, projecting inwardly of the dial 20 through a central opening 21 in the casing 11 for engagement by the respective coaxial drive shafts or arbors of the inner mechanism.

The sectional view of FIG. 2 illustrates the presence of a novel geographic hour hand radiant 22 or hemisphere disk attached to the normal hour hand 15, for rotation therewith under activation of the drive sleeve 12. In addition, FIGS. 1 and 2 illustrate the presence of a manually-rotatable annular hour ring 23 and a transparent cover 24. The ring 23 is provided with a fixed pointer or midnight mark 25 at the 24-hour location which permits the ring 23 to be aligned as shown in FIG. 1, with the 12-hour location at the top, 180° latitude therefrom, visually representative of the location of the Sun directly overhead at local noon time, and with the pointer 25 aligned with the hour mark 25*a* at the bottom of the dial, representative of 24 hours or midnight. If preferred, ring 23 can be rotated to any desired physical position on the clock, such as 180° so that the pointer 25 is aligned with the top hour mark 26 on the dial 20, as in the conventional twenty-four hour clocks. If desired, the ring 23, which represents the heavens relative to the rotating Earth, may also carry representations of the major planets in their correct positions relative to the Sun which would be positioned at the 12-hour location.

As shown most clearly by FIG. 2, the radiant 22 or hemisphere disk is attached to the usual hour hand 15 which makes one revolution each twenty-four hours, moving the radiant 22 as a part thereof. In the embodiment or design for the radiant 22 shown in FIG. 1, the radiant comprises a central ring 27 having a center of rotation corresponding to the axis of rotation of the Earth, four equally- and geometrically-spaced integral radial support extensions 28, 29, 30 and 31 and an integral annular peripheral continent ring 32 which comprises visually recognizable shapes 33A, B, C and D of portions of the major continents of the Southern Hemisphere as they would be viewed from a point in space below the South Pole, shown in accurate geographic location relative to each other and to the axis of rotation. The continent ring 32 also comprises a plurality of twenty-four radial pointers 34 which are uniformly spaced 15° from each other in one-hour increments, relative to the hour indicia on the dial 20 and on the annular hour ring 23. Alternate pointers 34 are illustrated with different shapes, as are the larger pointers 34*a, b, c* and *d* on each of the radial support extensions 28 to 31, respectively. As illustrated, the latter extensions contain the names of the major cities—London, Chicago and Calcutta, with the fourth extension 30 being marked Date Line. London extension 28 carries a dominant pointer 34*a*, representative of the coincidence between London time and Greenwich Mean Time, and the Date Line extension 30 extends in a direction 180° from the London extension 28, representative of the 12-hour time difference between countries in the Greenwich time zone and countries in the International Date Line time zone, such as the Fiji Islands and New Zealand. At the instant Prime Meridian or Greenwich time zone is at noon, a day ends and a new day begins in the International Date Line zone.

The Date Line extension 30 also comprises date symbols 35 and 36, adjacent its pointer 34*c*, which have visually recognizable different shapes and/or colors, for reasons which will be discussed more fully hereinafter.

The local hour hand 19 or pointer is adjustably and frictionally attached to the radiant 22 for rotation therewith. This permits the local hour hand 19 to be positioned on the radiant 22 to point to the time zone in which the viewer resides. The clock of FIG. 1 shows the local hour hand positioned one hour in advance of pointer 34*d* on the Chicago extension 31, representative of local time in the time zone which includes Eastern Standard Time in the United States.

The clock dial 20 illustrated by FIG. 1 comprises a plurality of twelve alternate bold hour marks 37, each of which is aligned with an alternate even-hour number 38 present on the hour ring 23, the odd hours between said numbers 38 being designated by indicia 39 on the ring 23. Between each pair of hour marks 37 on the dial 20 are four evenly-spaced minute marks 40 which, together with the hour marks 37, comprise sixty evenly-spaced marks representative of the sixty minutes of each hour and the sixty seconds of each minute. Thus, with respect to reading the time in seconds and minutes, as indicated by the position of the second hand 17 and the minute hand 16, respectively, the distance between adjacent minute marks 40 indicates one second or one minute, and the distance between adjacent hour marks 37 indicates five seconds or five minutes. When reading the time in hours, as indicated by the position of the pointers 34 of the radiant 22 which indicate the current hour in World continents and cities exemplified on the radiant 22, or as indicated by the local hour hand 19 which indicates the local hour, the 30° arc between adjacent bold hour marks 37 indicates a difference of two hours, while the 6° arc between adjacent minute marks 40 indicates a difference of twenty-four minutes relative to the hour hand 19. Thus, the clock of FIG. 1 indicates the local Eastern Standard Time to be 3:27:015, the local hour hand 19 pointing nearly halfway between the third hour, designated by the hour indicia 39, and the hour numbered 4 on the hour ring 23. The exact minutes and seconds are indicated by the minute hand 16 and the second hand 17, respectively. In addition, the radiant 22 provides the viewer with a visual illustration of the current time in all other sections of the World, geographic area 33A representing South America in which the current time is the same as, or one or two hours later than, Eastern Standard Time in the western, central and eastern portions thereof, respectively. Geographic area 33B represents Africa, area 33C represents the Maligasy Republic and 33D represents Australia. Also the radiant extensions 28, 29, 30 and 31 designate specific geographic locations, the Date Line extension 30 designating the Fiji Islands and New Zealand.

It should be understood that the geographic hand member or radiant 22 can be customized to suit the needs of the particular user by illustrating and/or naming geographic areas or cities which are of particular interest. For example, a corporation with branches or business affiliates in Los Angeles, New York, Lisbon and Tokyo could have a clock designed to include specific radiant extensions which name and point to those areas of the World, and/or a radiant which illustrates the geographic areas in which those cities are located even though such cities are located in the Northern Hemisphere.

The hour ring 23 of FIG. 1 also illustrates the presence of date symbols 35*a* and 36*a* to the right and left, respectively, of the 24-hour or midnight mark 25. The circular symbol 35*a* represents the "old" day, such as Apr. 11, 1981, which is still being experienced in the geographic areas of the World illustrated within the section of the radiant 22 between the 24-hour or midnight mark 25 on the ring 23 counterclockwise to the old date symbol 35 as marked by the pointer 34*c* of the Date Line extension 30, the circular "old" date symbol 35 being positioned on the leading or clockwise side of said pointer 34*c* to enable a quick correlation with the corresponding circular date symbol 35*a* on the hour ring 23 which is aligned with Date Line mark 25*a*. At the same time, the triangular date symbol 36*a* represents the "new" day, such as Apr. 12, 1981, which is concurrently being experienced in the geographic areas of the World which are illustrated within the section of the radiant 22 between the midnight mark 25*a* on the dial 20 clockwise to the "new" date symbol 36 as marked by the pointer 34*c* of the Date Line extension 30, the triangular date symbol 36 being positioned on the trailing or counterclockwise side of said pointer 34*c* to enable a quick correlation with the corresponding triangular date symbol 36*a* on the hour ring 23 at the midnight mark 25. Thus, a quick view of the clock 10 illustrates not only the current time in all parts of the World but also the areas of the World experiencing the "old" day, such as April 11, and the areas of the World experiencing the "new" day, such as April 12.

The instant of noon at the Prime Meridian, indicated by the London extension 28, coincides with the instant of midnight in the Fiji Islands and New Zealand, indicated by the alignment of Date Line extension 30 with the midnight mark 25 on the ring 23. At this instant the old day, April 11, ends and the entire World experiences only a single day, April 12. The next second begins another new day, April 13, in the Fiji time zone.

Figure 3:
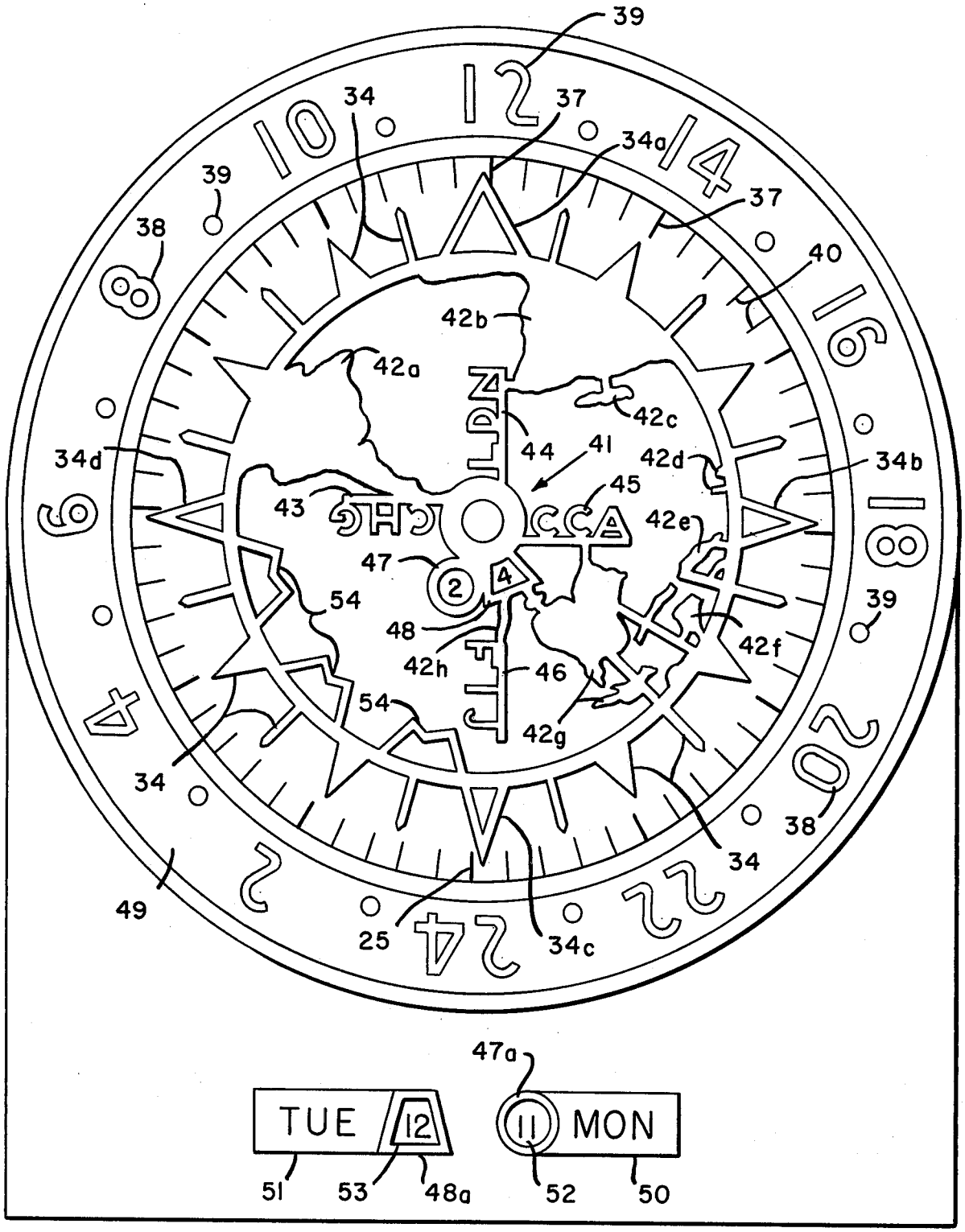
FIG. 3 is a front view of a twenty-four hour date clock according to another embodiment of the present invention, incorporating a digital display correlated to the clock radiant.

It will be clear to those skilled in the art that the clock of FIGS. 1 and 2 can be modified, as stated, to customize the geographic hand member or radiant 22 in any desired manner to provide a visual representation of any desired continents or countries of the World and/or specific references to countries or cities shown in their correct geographic locations or time zones. FIG. 3 illustrates a clock comprising a combination of a conventional hand clock and a digital clock including means for correlating the data shown by each type in order to provide a unitary display which gives the observer a visual picture of the time of day and date which coincide in different geographic areas of the World.

Thus, FIG. 3 illustrates one form of combined hand clock and digital calendar clock which provides the viewer with a visual representation of the time of day in various geographic areas of the World and also with a visual representation of the geographic areas of the World which are experiencing the two different coincident calendar days and the day of the week and the calendar month for the new day in the Fiji time zone or in the local time zone, as desired. In FIG. 3, the radiant 41 comprises the continents or geographic areas 42*a* (South America), 42*b* (Africa), 42*c* (Malagasy Republic), 42*d* (India and Syrilanka), 42*e* (Sumatra), 42*f* (Borneo), 42*g* (Australia and New Guinea) and 42*h* (New Zealand), illustrated in a more southerly location than is accurate geometrically, for purposes of clarity and in order to include countries or portions of continents which do not exist in the Southern Hemisphere. Also, the radial support extensions 43, 44, 45 and 46 are designated as CHG (Chicago), LDN (London), CCA (Calcutta) and FIJ (Fiji), respectively. The latter extension 46 corresponds to the International Date Line and comprises the circular symbol 47, representing the old day, and the triangular symbol 48, representing the new day, on the leading and trailing sides of the extension 46, respectively.

In FIG. 3, the old day symbol 47 and the new day symbol 48 are shown with the numbers "2" and "4" contained therewithin, respectively, and the midnight mark 25 on the dial has the inverted numbers "4" and "2" on opposite sides thereof, comprising the inverted hour number "24". The geometric symbols 47 and 48 are correlated with the companion symbols 47*a* and 48*a* and the companion "2" and "4∞ numbers on the radiant and on the dial are also correlated to reinforce the geometric symbols and provide the desired companion symbols to give the viewer a quick visual indication of the continents on the radiant lying between the companion geometric symbols and between the companion "2" symbols (experiencing the old day) and the companion "4" symbols (experiencing the new day).

As in the embodiment of FIGS. 1 and 2, the radiant 41 of FIG. 3 is provided with a local hour hand, a minute hand and a second hand corresponding to hands 16, 17 and 19 of FIGS. 1 and 2, which are not shown in FIG. 3. Such hands and the radiant 41 are attached to coaxial shafts of the inner clock mechanism in the same manner as discussed and illustrated with reference to FIG. 2.

The dial 49 of FIG. 3 incorporates the alternate hour numbers 38 and hour indicia 39, the bold hour indicia 37 and minute indicia 40 in the same manner as the embodiment of FIG. 1, and the radiant includes the twenty-four hour pointers 34 equally-spaced by 15° around the outer periphery of the radiant 41. These indicia, in association with the positions of the radiant 41 and local hour, minute and second hands 16, 17 and 19 provide a visual illustration of the local time and the concurrent time around the World. In FIG. 3 the radiant 41 is positioned just before midnight, Fiji time. At this point the Fiji time zone and nearly the entire Earth is experiencing the new day of April 12 while the old day of April 11 is just ending in the time zone in advance of Fiji. At the instant of midnight, Fiji time, the entire Earth is experiencing the same day, April 12. At the next instant another new day, April 13, begins in the Fiji time zone when it is just past noon, April 12, in the Greenwich time zone.

FIG. 3 includes a digital display of the day of the week 50 corresponding to the date 52 of the old day, the day of the week 51 corresponding to the date 53 of the new day, the date 52 of the old day being shown within the circular date symbol 47a symbolic of the old day and the date 53 of the new day being shown within the triangular date symbol 48a symbolic of the new day. The embodiment of FIG. 3 provides the viewer not only with a visual indication of the geographic areas of the World experiencing the new and the old days but also with a specific identification of the day of the week and date of both the new and the old days, namely Tuesday the 12th and Monday the 11th, respectively. At the moment after midnight, Fiji time, the dates 53 and 52 will each advance to "13" and "12", respectively, and the day displays 51 and 50 will advance to "WED" (Wednesday) and "TUES" (Tuesday), respectively, to illustrate the end of Monday, April 11, the nearly total World day of Tuesday, April 12, and the end of Tuesday, April 12 and the start of Wednesday, April 13 in geographic areas of the World located between the fixed twenty-four hour mark 25 on the lower part of the dial 49 and the clockwise advance position of the moving pointer 34c of the Fiji extension 46 of the radiant 41. Thus, after midnight of Tuesday, April 12, it becomes Wednesday, April 13 in the Fiji time zone, and in each time zone in the easterly or clockwise direction from the Fiji time zone or International Date Line which is overtaken by the pointer 34 of the Fiji extension 46. Concurrently, it is still Tuesday, April 12 in all of the other geographic areas of the World illustrated on the arc or portion of the radiant lying between the dial pointer 25 and the pointer 34c of the Fiji extension 46 in the counterclockwise or westerly direction. For example, at 0600 hours or 6 A.M. Fiji time, on Wednesday, April 13, it is 1200 hours or noon time Chicago time, on Tuesday, April 12.

It will be clear to those skilled in the art that the digital display of the day and dates shown in FIG. 3 are controlled by conventional electrical or mechanical clock means which are well-known and which are synchronized with the chronometer mechanism or works of the hand clock in order to change displays after the instant of midnight, Fiji time, as indicated by the alignment of the pointer 34c of extension 46 with the 24-hour mark 25 of the clock dial 49. It will also be clear that the digital display can include a display of the month and/or year, if desired. Also, digital displays may be provided for the days and dates in local time zones.

The radiants 22 of FIG. 1 and 41 of FIG. 3 also illustrate the integral fanciful intials WWW 54 which represent the trademark "Weller World Watch" for the novel clocks of the present invention.

In their most simplified form, the novel date clocks of the present invention comprise a fixed dial and a 24-hour geographic radiant having a pointer positioned at the International Date Line. The leading edge of the pointer, or geographic east, is associated with a symbol on the radiant representative of the old day and the trailing edge of the pointer, or geographic west, is associated with a visually-distinguishable symbol representative of the new day. The fixed dial is provided with a midnight or 24-hour mark and with fixed visually-distinguishable symbols associated with said mark and corresponding to similar or companion symbols present on the moving radiant. The old date symbol on the dial is located on the right side or western side of the midnight mark and defines between its side of the midnight mark and the companion symbol on the radiant, in the counterclockwise direction, the geographic areas of the World, illustrated on the radiant, which are still experiencing the old day. The new date symbol on the dial is located on the left side or eastern side of the midnight mark and defines between its side of the midnight mark and the companion symbol on the radiant, in the clockwise direction, the geographic areas of the World, illustrated on the radiant, which are experiencing the new day. As discussed hereinbefore, the date symbols 35 and 36 of FIG. 1 and 47 and 48 of FIG. 3 may be geometric symbols, as illustrated, or may take any other form in which they provide visually-distinguishable symbols having companion symbols on the dial, such as the numbers "2" and "4" illustrated by FIG. 3. If desired, the symbols may have similar shapes but different colors which match with the colors of the companion symbols, i.e., a red dot or circle for the symbols 36 nd 36a and a blue dot or circle for the symbols 35 and 35a of FIG. 1.

The radiants 22 and 41 illustrated by FIGS. 1 and 3 may be fabricated from any desired material such as metal, plastic or the like. Most preferably, they are formed from lightweight materials so as to be easily rotatable by means of conventional chronometer works, particularly in the case of wristwatches. For example, the radiants can be formed from thin guage gold, nickel or other metal which can be etched to partially or completely remove portions, illustrated by the drawing, as spaced interconnected portions or as raised or polished portions against contrasting etched and dull recessed portions. Alternatively, the radiants may be formed of thin, lightweight plastic which are printed, solvent-etched or metallized with the desired geographic continents, date line extensions and peripheral pointers.

Variations and modifications of the present invention will be apparent to those skilled in the art within the scope of the present claims.

I claim:

1. A twenty-four hour date clock comprising a casing containing a chronometer mechanism comprising at least one central axial shaft which is adapted to make one complete clockwise revolution every twenty-four hours, a dial on said casing having a central opening, a geographic hand member attached to said shaft through said central opening of the dial and extending parallel to and closely spaced from the surface of said dial for 360° rotation with said shaft around said dial, said hand member comprising indicia of geographic areas of the Earth in various geographically-accurate radial directions relative to the axis of rotation of said hand member which coincides with the axis of rotation of the Earth, and at least one date pointer means adjacent an extremity of said hand member and located in a geographically-accurate position relative to said geographic areas to indicate the time zone of the International Date Line, visually-distinguishable old day- and new day-indicating symbols on the clockwise and counterclockwise sides of said pointer means, respectively, said dial comprising a fixed midnight mark which is located for alignment with said pointer means of said hand member once during each twenty-four hour rotation of said hand member to coincide with the end of the old calendar day and start of another new calendar day in the time zone of the International Date Line, visually-associatable companion old day- and new day-indicating symbols affixed to said dial on the counterclockwise and clockwise sides of said midnight mark, respectively, and adjacent thereto, said clock providing a visual indication of geographic areas of the World experiencing the old day, comprising the geographic area indicia present on said hand means in the counterclockwise portion thereof located between the midnight mark on the dial and said hand member, said geographic area being visually-illustrated as the area between said companion old day symbols, and geographic areas experiencing the new day, comprising the geographic area indicia present on said hand means in the clock-wise portion thereof located between the midnight mark on the dial and said hand member, said geographic area being visually-illustrated as the area between said companion new day symbols.

2. A time and date clock according to claim 1 in which said hand member also contains area indicator points at extremities thereof which are in radial alignment with said geographic area indicia to indicate the time zones in which said geographic areas are located, and said dial comprises twenty three hour indicia which are evenly spaced from each other and from said midnight mark around the periphery of said dial, the alignment of said area indicator points of said hand member and said hour indicia of said dial providing a visual indication of the local hour in each of said geographic areas.

3. A time and date clock according to claim 2 in which the chronometer mechanism within the casing of the clock also comprises a coaxial shaft which is adapted to make one complete clockwise revolution every sixty minutes, a minute hand attached to said coaxial shaft, extending parallel to and closely spaced from said geographic hand member and having a minute-indicator point adjacent an extremity thereof, and said dial comprises sixty minute indicia, which include said twenty three hour indicia and said midnight mark, eveninly spaced from each other around the periphery of said dial, the alignment of said minute-indicator point with said minute indicia of said minute hand providing a visual representation of the number of minutes which have expired since the previous hour in any geographic area of the World.

4. A twenty-four hour date clock according to claim 1 or claim 3 in which said geographic hand member comprises a circular map member comprising recognizable outlines of at least portions of some of the continents of the Earth.

5. A twenty-four hour date clock according to claim 1 or claim 3 in which said geographic hand member also comprises a local hour pointer which is manually-positionable on said hand member to indicate the hour in any local time zone relative to Greenwich Mean Time.

6. A twenty-four hour date clock according to claim 1 in which old day- and new day-indicating symbols on said dial comprise elements of digital display clocks whereby the numerical values of the new day and of the old day are automatically displayed in association with the corresponding symbols and are automatically changed to coincide with the end of one day and the beginning of another new day at the International Date Line time zone.

7. A twenty-four hour date clock according to claim 6 in which said elements of said digital display clocks also provide a visual display of the day of the week corresponding to the new day.

8. A twenty-four hour date clock according to claim 6 in which said elements of said digital display clocks also provide a visual display of the day of the week corresponding to the old day.

9. A twenty-four hour date clock according to claim 2 in which said dial comprises a manually-rotatable annular ring carrying said twenty three hour indicia and said midnight mark, said ring being adjustable so that said midnight mark can be aligned with any desired physical position on the clock.

10. A twenty-four hour time and date clock comprising a casing containing a chronometer mechanism comprising two central coaxial shafts which are adapted to make one complete clockwise revolution every twenty-four hours and every sixty minutes. respectively, a dial on said casing having a central opening, a circular geographic hand member attached to said twenty-four hour shaft through said central opening of the dial and extending parallel to and closely spaced from the surface of said dial for 360° rotation with said shaft around said dial, said hand member comprising indicia of geographic areas of the world corresponding to the Southern Hemisphere in various geographically-accurate radial directions relative to the axis of rotation of said hand member which coincides with the axis of rotation of the Earth, and a plurality of peripheral pointer means adjacent the extremity of said hand member, one said pointer means being a date pointer located in a geographically-accurate position relative to said geographic areas to indicate the time zone of the International Date Line, visually-distinguishable old day- and new day-indicating symbols on the clockwise and counterclockwise sides of said date pointer, respectively, said dial comprising a midnight mark which is located for alignment with the pointer means of said geographic hand member once during each twenty-four hour rotation of said hand member to coincide with the end of the old calendar day and start of another new calendar day in the time zone of the International Date Line, visually-distinguishable old day- and new day-indicating symbols on said dial corresponding to the symbols present on said date indicator, said symbols on said dial being located adjacent opposite sides of said midnight mark in the counterclockwise and clockwise directions, respectively, said clock providing a visual indication of geographic areas of the World experiencing the old day, comprising the geographic area indicia present on said geographic hand means in the counter-clockwise portion thereof located between the side of the midnight mark on the dial carrying the old-day indicating symbol and the corresponding old day-indicating symbol on said hand member, and geographic area experiencing the new day, comprising the geographic area indicia present on said hand means in the clockwise portion thereof located between the side of the midnight mark on the dial carrying the new day-indicating symbol and the corresponding new day-indicating symbol on said hand member, a minute hand attached to the one of said coaxial shafts which is adapted to make one complete clockwise revolution every sixty minutes, said minute hand extending parallel to and closely spaced from said circular geographic hand member and having a minute-indicator point adjacent an extremity thereof, and sixty minute indicia, which include said twenty three hour indicia and said midnight mark, evenly spaced from each other around the periphery of said dial, the alignment of said minute-indicator point with said minute indicia of said minute hand providing a visual representation of the number of minutes which have expired since the previous hour in any geographic area of the World.

* * * * *